US007551092B1

(12) United States Patent
Henry

(10) Patent No.: US 7,551,092 B1
(45) **Date of Patent: *Jun. 23, 2009**

(54) SANITARY MONITORING SYSTEM TO MONITOR THE HAND SANITATION OF HEALTH CARE WORKERS OR OTHER REQUIRED SANITARY ACTIVITIES

(76) Inventor: Kevin M. Henry, 8116 NW. 100th St., Oklahoma City, OK (US) 73162

( * ) Notice: Subject to any disclaimer, the term of this patent is extended or adjusted under 35 U.S.C. 154(b) by 248 days.

This patent is subject to a terminal disclaimer.

(21) Appl. No.: 11/599,707

(22) Filed: Nov. 15, 2006

(51) Int. Cl.
*G08B 23/00* (2006.01)

(52) U.S. Cl. ..... 340/573.1; 340/286.07; 340/539.12; 340/572.1

(58) Field of Classification Search ..... 340/572.1, 340/573.1, 539.12–539.13, 286.07; 700/302; 134/18; 222/1, 23
See application file for complete search history.

(56) References Cited

U.S. PATENT DOCUMENTS 4,286,331 A 8/1981 Anderson
5,610,589 A * 3/1997 Evans et al. ..... 340/573.1
5,812,059 A * 9/1998 Shaw et al. ..... 340/573.1
6,029,600 A 2/2000 Davis
6,150,948 A 11/2000 Watkins
6,774,782 B2 8/2004 Runyon
6,912,398 B1 6/2005 Domnitz
6,933,849 B2 8/2005 Sawyer
2005/0134465 A1 * 6/2005 Rice et al. ..... 340/573.1

* cited by examiner

*Primary Examiner*—Brent Swarthout
(74) *Attorney, Agent, or Firm*—Randal D. Homburg

(57) ABSTRACT

A monitoring system for health care workers or other workers where sanitary hand-washing is required, to detect the sanitary cleaning of hands upon entry and exit of a required or designated clean area includes a plurality of individual RFID devices located within the uniforms or employee ID badges assigned to each employee, a central monitoring network comprising a plurality of proximity sensors located at each room entry, the soap dispenser and the sink, the patient or object where sanitary handling is required, and a CPU. Each individual RFID device, when within the set range of each proximity sensor, sends a signal to the central monitoring device corresponding to the assigned employee, which in turn, relays the signal to the CPU in real time, for a time relative log of the employees activity to monitor whether the employee has washed their hands as required by law or policy.

1 Claim, 3 Drawing Sheets

SANITARY MONITORING SYSTEM TO MONITOR THE HAND SANITATION OF HEALTH CARE WORKERS OR OTHER REQUIRED SANITARY ACTIVITIES

CROSS REFERENCE TO RELATED APPLICATIONS

U.S. application Ser. No. 11/478,048 to same inventor, Kevin M. Henry and same assignee, Go Technologies, Inc.

I. BACKGROUND OF THE INVENTION

1. Field of Invention

A monitoring system for health care workers or other workers where sanitary hand-washing is required, to detect the sanitary cleaning of hands upon entry and exit of a required or designated clean area includes a plurality of individual radio frequency identification device (RFID) devices located within the uniforms or employee ID badges assigned to each employee, a central monitoring network comprising a plurality of proximity sensors located at each room entry, the soap dispenser and the sink, the patient or object where sanitary handling is required, and a central processing unit (CPU). Each individual RFID device, when within the set range of each proximity sensor, sends a signal to the central monitoring device corresponding to the assigned employee, which in turn, relays the signal to the CPU in real time, for a time relative log of the employees activity to monitor whether the employee has washed their hands as required by law or policy.

2. Description of Prior Art

The following United States patents were discovered and are disclosed within this application for utility patent. Some prior art relates to hand sanitation devices, but the majority of the disclosed prior art is relative to the field of RFID devices.

In U.S. Pat. No. 6,029,600 to Davis, an aerosol spray of disinfectant is attached to a door to spray a dye stain on the restroom user's hand when the door handle is opened. Soap and water is required to remove the stain on the user's hand, and likely anything else that gets sprayed with the annoying dye.

RFID technology is well-known in the prior art, especially as used in tracking people and objects. A garment tracking system is disclosed in U.S. Pat. No. 5,785,181 to Quartararo, Jr. which imbeds an RFID device in garment buttons or within the garment itself. Name badges or ID badges contain the RFID tracking devices attached to people in U.S. Pat. No. 6,933,849 to Sawyer and RE37,531 to Chaco, which involve the monitoring of people within a workplace or objects to track the whereabouts of the people or objects for security reasons, employing multiple sensors to track the location.

Monitoring of persons within a location to track the entry into a room or within the proximity of a dangerous appliance used in the home health care industry is disclosed in U.S. Pat. No. 4,286,331 to Anderson. It does not specifically disclose RFID technology, but photo-sensors are employed as well as other "sensor means". Proximity sensors using RFID technology are disclosed in U.S. Pat. No. 6,150,948 to Watkins, disclosing a stationary reader and a plurality of tags which are read when in the presence of the reader. This passive RFID technology becomes active when the tagged item is found within the sensory field and appears to be closely related to inventory security to create an active signal when an object is placed within the sensory field, as would be the case if an item is being shoplifted.

The present RFID system is ideally tailored for the health service industry and is primarily concerned with monitoring hand-washing with soap for sterile environment handling safety in an attempt to reduce transmittal and transfer of disease from infected patients to other patients, medical equipment or sterile areas caused by lack of sanitary cleansing after contact and upon entry onto a sterile area. The RFID transmitting device is placed upon an employee or guest with multiple primary RFID detection devices located on all the entries to each individual sterile area, which are triggered upon entry by the employee or guest, sending a wireless signal to the RFID receiving device located within each entry and the sterile target area. Secondary RFID detection devices are located in the proximity of each of the soap dispensers and sinks to detect the proximity of the employee or guest within the proximity of the soap dispenser and sink, these secondary RFID detection devices sending a signal to the RFID receiving device. When the employee or monitored guest fails to activate the required secondary RFID detection devices within a programmed time of detection after entry or prior to exiting the room or area, an alert is sent to a central monitoring station with information that the corresponding employee or monitored guest has failed to exercise proper hand cleansing in that particular area.

This system may also be applied to any industry or in manufacturing plants which utilize clean-room technology or required sanitary hand-cleansing to prevent risk of contamination or spread of disease or germs.

II. SUMMARY OF THE INVENTION

Contamination caused by the spread of germs, bacteria and disease, especially in the health care industry, has led to staff infection, spread of infectious disease and risks to patients in clinics and hospitals. Health safety alerts for Hepatitis, HIV, and other communicable viral and bacterial disease often can be prevented by the simple washing of hands. Many health care facilities are required by law or by internal policy to require guests, workers and caretakers to wash their hands upon entry and prior to exiting a room where patients are cared for, as well as rooms where surgical supplies, medications and sterilization of instruments are located. Most facilities will post warning signs, but these signs can only convey the risks involved in failure to wash an employees hands. They cannot detect and monitor compliance with local, state and federal health requirements or adherence to policies of the institutions.

The present RFID system provides an employer with a means of monitoring employee or guest's hand cleansing and alerting the employer to a violation of hand sanitation requirements by employees in the industry to which the present technology and method are utilized. Employers may also utilize the system for disciplinary actions against the employees, to assist in tracing the pathway of an instance of contamination or origin of disease, and to isolate non-compliant employees who fail to cleanse their hands in the event of a disease outbreak relative to contamination.

The primary objective of the sanitary hands monitoring system is to provide an employer in the service industry with the ability to detect employees who do not wash their hands according to law or policy. A secondary objective is to provide this monitoring system to the health care industry to prevent the spread of disease, locate policy and law offending employees or others, and the track the spread of disease to locate a point of origin. A third objective is to apply the monitoring system in any business or industrial application where the spread of disease or contamination of an object or person is a concern.

III. DESCRIPTION OF THE DRAWINGS

The following drawings are submitted with this utility patent application.

IV. DESCRIPTION OF THE PREFERRED EMBODIMENT

Figure 1:
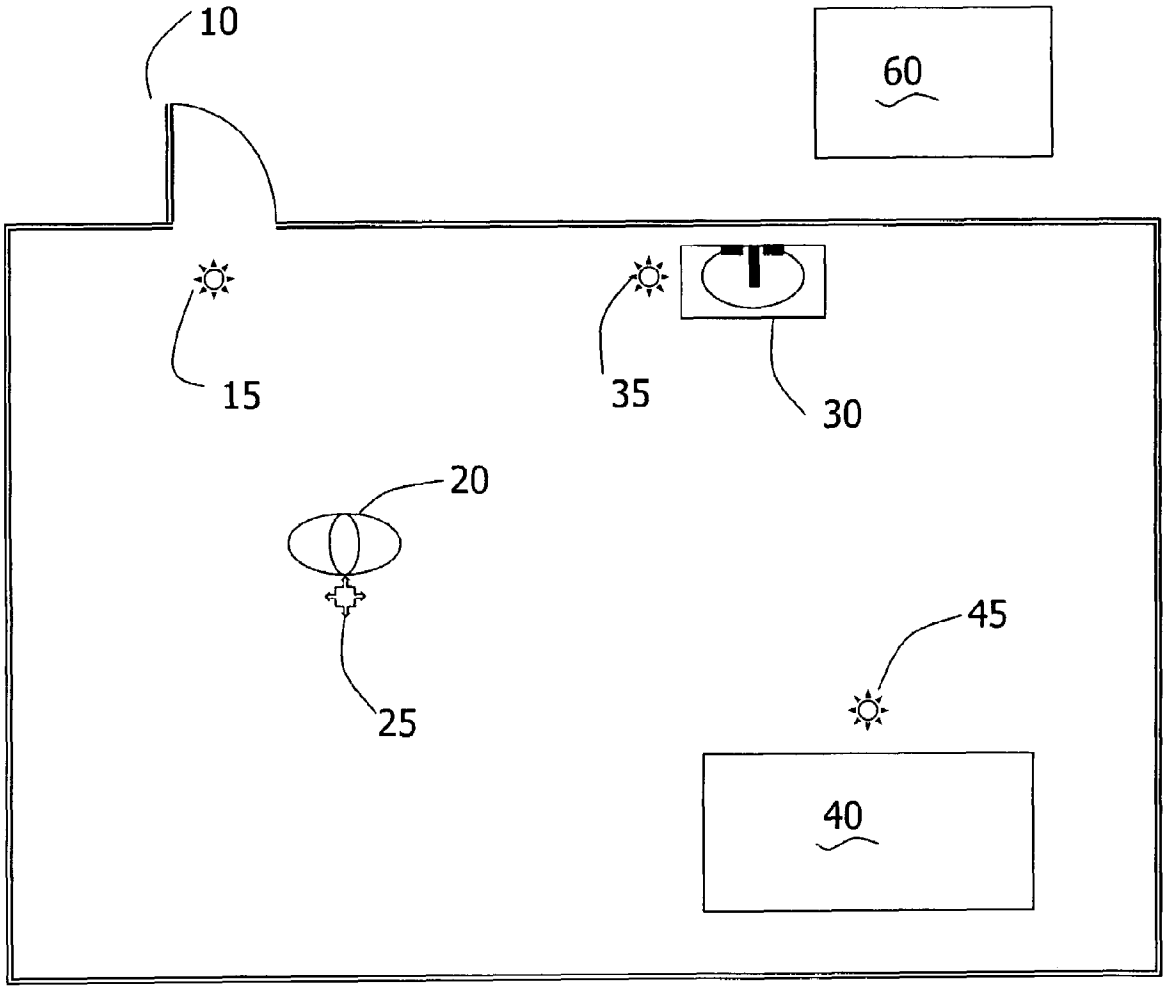
FIG. 1 is a diagram of the system in a single room in a health care facility, specifically a patient or sterile room.
Figure 2:
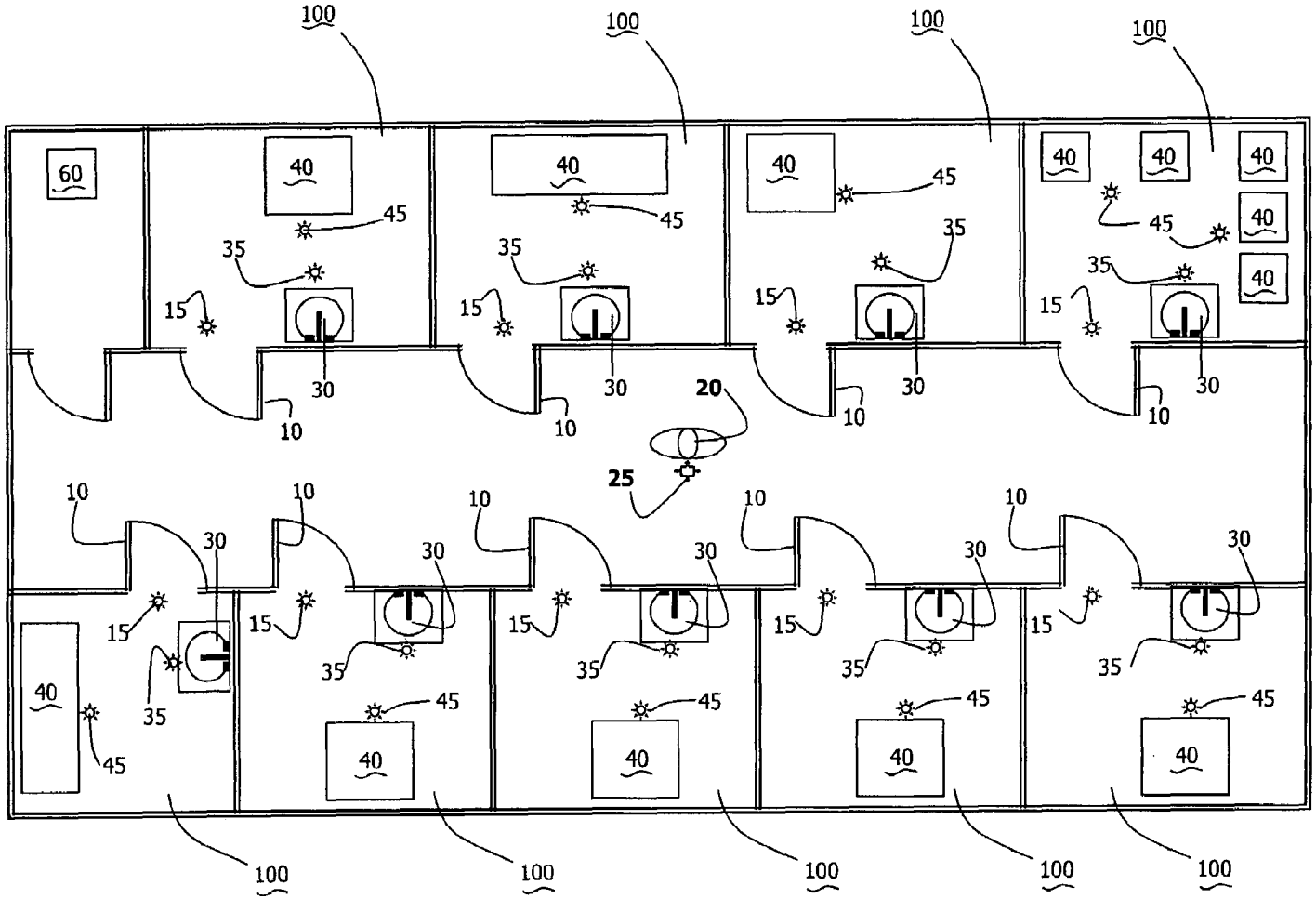
FIG. 2 is a diagram of the system in a health care facility with multiple rooms.
Figure 3:
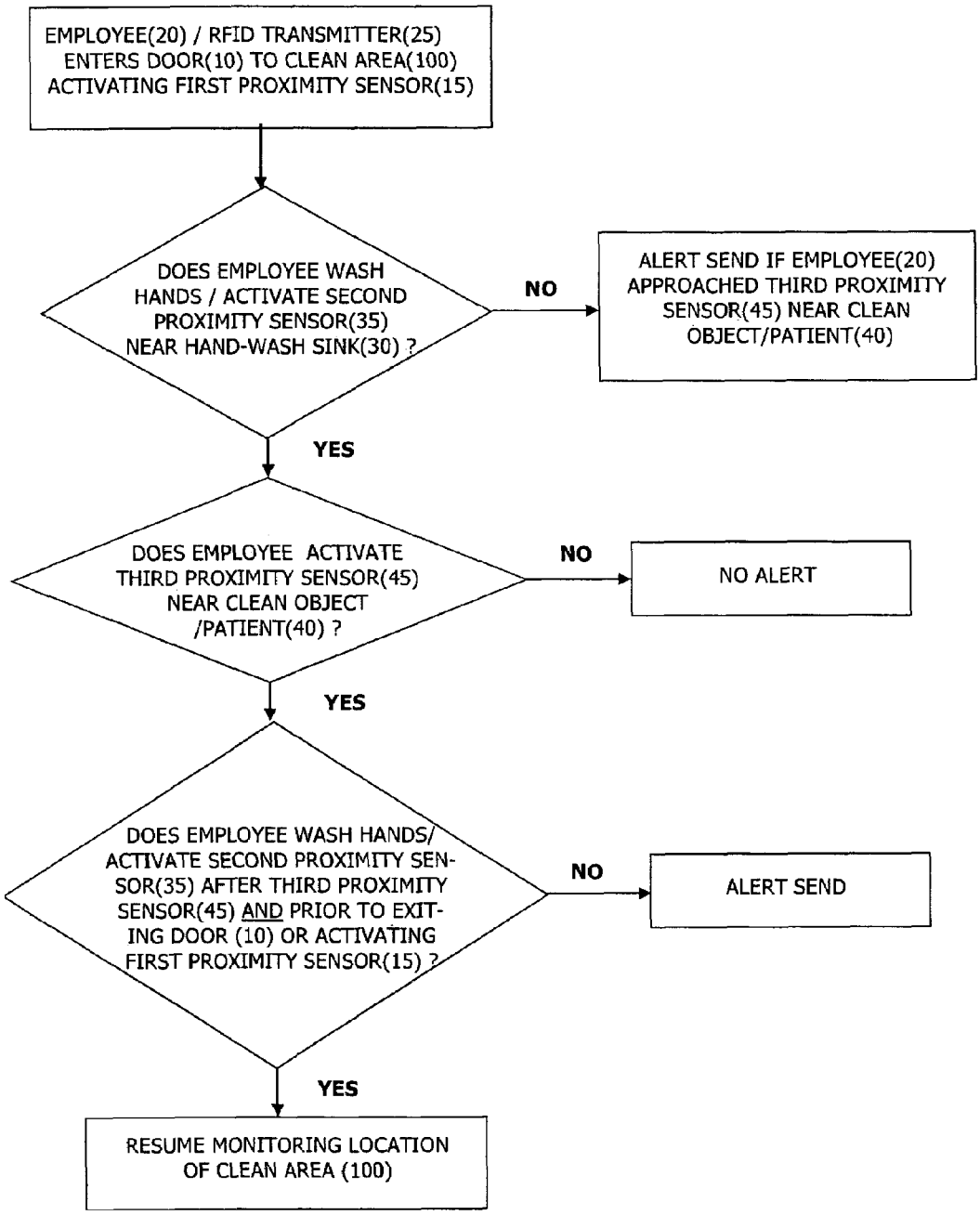
FIG. 3 is a flow chart representing the monitoring system application when an employee enters the clean area to determine if the employee has washed their hands as required by law or policy in a correct sequence.

A sanitary and sterile monitoring system and method provides monitoring of employees or monitored guests after entry into at least one room 100 in a location where hand washing is required, most preferably a health care facility, to monitor the hand-washing of employees 20 or guest upon entry and exit of each room, shown in FIGS. 1-3 of the drawings, the monitoring system comprising at least one radio frequency identification device, or RFID transmitter 25 worn upon at least one employee 20, a first RFID proximity sensor 15 located at the door 10 of each room 100 which transmits a first RFID signal when activated by the presence of the RFID transmitter 25, a second RFID proximity sensor 35 located at a hand-washing station 30 having a soap dispenser and sink within each room 100 which transmits a second RFID signal when activated by the presence of the RFID transmitter 25, and a third RFID proximity sensor 45 located at a clean target 40 within the room 100 which transmits a third RFID signal when activated by the presence of the RFID transmitter 25, and a central monitoring station 60 having an appropriate computer software monitoring program installed to monitor the activity within each room of the location being monitored, the central monitoring station 60 receiving the first, second and third RFID signals transmitted by the respective first, second and third RFID proximity sensors 15, 35, 45 to track the movement and activity of the employee 20 identified by the RFID transmitter 25 in each room 100.

The first, second and third RFID signals may be transmitted by a wireless means or a hard-wired means from the respective first, second and third RFID proximity sensors 15, 35, 45 to the central monitoring system 60. Each RFID transmitter 25, in the event there are more than one employee 20 wearing RFID transmitters 25, would be assigned a unique and individual RFID transmitter identity, to isolate each employee 20 from another so that the central monitoring station 60 can track each employee separately but concurrently. The clean target 40 within each room may be identified as a patient bed, a laboratory table, a medicine or surgical supply cabinet, a nursery, a waste disposal area or any object within the location or facility which requires or recommends hand washing upon entry or prior to exiting a room 100.

The manner in which the system operates would require each employee 20 or monitored guest to wear an RFID transmitter 25 upon their person, either within a uniform or within a name badge or employee ID card. This RFID transmitter 25 should be worn at a location upon the employee which would activate each of the RFID proximity sensors 15, 35, 45 when within a specific range of each RFID proximity sensor 15, 35, 45, preferably overhead or near the employee's chest level. As the RFID transmitter 25 passes within the set range of the respective RFID proximity sensor 15, 35, 45 throughout the location from room to room, the RFID proximity sensor is activated to send an RFID signal to the central monitoring station 60. This enables the employer, sanitary compliance director or supervisor to track the movement and activity of an employee when they enter specific control rooms where hand-washing is required by law or policy to determine if the employee has washed their hands within a pre-set period or in a required sequence.

To determine if an employee complies with a requirement that the employee wash their hands upon entry to and prior to exiting a room, as indicated in FIG. 3, the RFID transmitter 25 on the employee 20 activates the first RFID proximity sensor 15 installed at the door 10 of the room 100. If the RFID transmitter 25 on the employee 20 activates the second RFID proximity sensor 35 at the hand-washing station 30 subsequent to the activation of the first RFID proximity sensor 15 prior to activating the third RFID proximity sensor 45 near the clean target 40, there is no alert noted on the central monitoring system 60, indicating that the employee 20 has conducted hand-washing prior to contact with the clean target 40. However, if the third RFID proximity sensor 45 near the clean target 40 is activated prior to the activation of the second RFID proximity sensor 35 after entry into the room 100, then an alert send signal is noted on the central monitoring system 60 indicating contact with the clean target 40 prior to use of the hand-washing station 30. Subsequent to contact with the clean target 40 and the activation of the third RFID proximity sensor 35, the employee 20 is required to conduct hand-washing prior to exiting the room 100. Thus, if the second RFID proximity sensor 35 is not activated after the activation of the third RFID proximity sensor 45 and prior to the activation of the first RFID proximity sensor 15, an alert signal is noted at the central monitoring station 60 indicating the employee 20 has left the room 100 without conducting hand-washing at the hand-washing station 30. If the employee 20 activates the second RFID proximity sensor 35 after activation of the third RFID proximity sensor 45 prior to the activation of the first RFID proximity sensor 15, no alert is noted at the central monitoring station 60.

It is contemplated within the scope of this system that numerous employees 20 may be working in the location and that there may be multiple rooms 100 where hand-washing is required upon entry and prior to exiting each room 100. Employers receiving an alert signal on a particular employee would have the opportunity to reprimand the violating employee or enable the employer to track the source of a contamination within the location. By utilizing the system, a reduction in contamination or transfer of viral or infectious disease from dirty hands could be avoided or significantly reduced.

It would also be contemplated within the scope of this system that additional RFID proximity sensors may be placed throughout the location in other areas where a likelihood of germ or disease transfer could occur, including placement within janitorial closets, lavatories, food preparation areas, locker rooms, or loading areas to monitor hand sanitation prior to resuming contact with clean targets after touching possible contaminated materials.

What is claimed is:

1. A sanitary and sterile monitoring system to determine if each of a plurality of employees has conducted required hand-washing procedures upon entry and prior to exiting a room where hand washing is required, the monitoring system comprising:

a plurality of unique and individually assigned RFID transmits worn upon each of a plurality of respective employees, a first RFID proximity sensor located at a door of each at least one room transmitting a first RFID signal when activated by the presence of said assigned RFID transmitter;

a second RFID proximity sensor located at a hand-washing station within each at least one room transmitting a second RFID signal when activated by the presence of said assigned RFID transmitter;

a third RFID proximity sensor located at an at least one clean target within said at least one room transmitting a third RFID signal when activated by the presence of said assigned RFID transmitter; and a central monitoring station having an appropriate computer software monitoring program installed to monitor activity within said at least one room, said central monitoring station receiving said first, second and third RFID signals transmitted by said respective first, second and third RFID proximity sensors to track movement and hand-washing activity of each said employee wearing said assigned RFID transmitter in each at least one room, wherein each of said plurality of unique and individually assigned RFID transmitters, upon obtaining a presence within each at least one room and each within proximity of each said first, second and third RFID proximity sensor sends a corresponding first, second or third RFID signal to said central monitoring station to record hand-washing of each of said plurality of employees within each at least one room within which hand-washing is required;

each said RFID transmitter on each said employee activating said first RFID proximity sensor installed at said door of said at least one room upon entry into said at least one room sending said first RFID signal to said central monitoring station;

each said RFID transmitter on each said employee activating said second RFID proximity sensor at said hand-washing station sending said second RFID signal to said central monitoring station subsequent to activation of said first RFID proximity sensor and prior to activation of said third RFID proximity sensor near said clean target, wherein no alert is noted on said central monitoring system, confirming that each said employee has conducted hand-washing prior to contact with said clean target;

further said RFID transmitter on each said employee activating said third RFID proximity sensor near said clean target prior to activation of said second RFID proximity sensor and subsequent to activation of said first RFID proximity sensor upon entry into said at least one room, wherein an alert is noted on said central monitoring system indicating contact with said clean target by said employee prior to conducting hand-washing;

further, wherein each said employee is required to conduct hand-washing prior to exiting said at least one room, said RFID transmitter on each said employee activating said first RFID proximity sensor upon exiting said at least one room subsequent to activation of said third RFID proximity sensor and prior to activation of said second RFID proximity sensor, an alert signal is noted on said central monitoring station indicating each said employee has left said at least one room without conducting hand-washing at said hand-washing station; and further, wherein each said employee is required to conduct hand-washing prior to exiting said at least one room, said RFID transmitter on each said employee activating said second RFID proximity sensor subsequent to activation of said third RFID proximity sensor but prior to activation of said first RFID proximity sensor, no alert is noted at said central monitoring station indicating each said employee has left said at least one room after conducting hand-washing at said hand-washing station.

* * * * *